United States Patent [19]

Christensen

[11] Patent Number: 4,878,538

[45] Date of Patent: Nov. 7, 1989

[54] PERFORATE, TEST AND SAMPLE TOOL AND METHOD OF USE

[75] Inventor: Jon B. Christensen, Ankeny, Iowa

[73] Assignee: Halliburton Company, Duncan, Okla.

[21] Appl. No.: 312,323

[22] Filed: Feb. 15, 1989

Related U.S. Application Data

[63] Continuation of Ser. No. 244,627, Sep. 12, 1988, abandoned, which is a continuation of Ser. No. 64,285, Jun. 19, 1987, abandoned.

[51] Int. Cl.[4] ..... E21B 49/08

[52] U.S. Cl. ..... 166/264; 166/297; 166/332; 175/59

[58] Field of Search ..... 166/167, 168, 169, 55, 166/228, 332, 336, 250, 264, 297; 175/50, 58, 59

[56] References Cited

U.S. PATENT DOCUMENTS

| | | | |
|---|---|---|---|
| 2,169,559 | 8/1939 | Halliburton | 166/1 |
| 2,740,479 | 4/1956 | Schwegman | 166/145 |
| 2,947,361 | 8/1960 | Hyde | 166/100 |
| 2,982,130 | 5/1961 | McMahan | 73/155 |
| 3,103,811 | 9/1963 | Ayres et al. | 73/152 |
| 3,189,094 | 6/1965 | Hyde | 166/55.1 |
| 3,253,654 | 5/1966 | Briggs, Jr. et al. | 166/100 |
| 3,254,531 | 6/1966 | Briggs, Jr. | 73/155 |
| 3,273,647 | 9/1966 | Briggs, Jr. et al. | 166/100 |
| 3,273,659 | 9/1966 | Reynolds, Jr. | 175/4 |
| 3,358,755 | 12/1967 | Chisholm | 166/3 |
| 3,456,726 | 7/1969 | Barrington et al. | 166/162 |
| 3,610,335 | 10/1971 | Smith | 166/55.1 |
| 3,664,415 | 5/1972 | Wray et al. | 166/0.5 |
| 3,964,305 | 6/1976 | Wray et al. | 73/151 |
| 3,969,937 | 7/1976 | Barrington et al. | 73/151 |
| 4,063,593 | 12/1977 | Jessup | 166/317 |
| 4,324,293 | 4/1982 | Hushbeck | 166/317 |
| 4,426,882 | 1/1984 | Skinner | 73/155 |
| 4,452,313 | 6/1984 | McMahan | 166/373 |
| 4,480,690 | 11/1984 | Vann | 166/250 |
| 4,657,082 | 4/1987 | Ringgenberg | 166/336 |
| 4,657,083 | 4/1987 | Ringgenberg | 166/374 |
| 4,665,983 | 5/1987 | Ringgenberg | 166/250 |

OTHER PUBLICATIONS

Halliburton Services Sales & Service Catalog No. 43, pp. 2533 and 2534, published 1985.

Vann Systems Engineered Well Completion Product Catalog, p. B-22.

*Primary Examiner*—Stephen J. Novosad

*Assistant Examiner*—Terry Lee Melius

*Attorney, Agent, or Firm*—James R. Duzan; Neal R. Kennedy

[57] ABSTRACT

A perforate, test and sample tool for obtaining fluid samples from a formation reservoir in a well. The tool comprises a retrievable packer, perforating guns and a sampler disposed between the packer and guns which is adapted for entrapping a fluid sample without flowing well fluids into the tool string. An operating position is slidably disposed in a cylinder above the packer and is used to actuate a sampler valve in the sampler. A seal insures that all portions of a sampling chamber in the sampler are disposed below the packer. In one embodiment, the operating piston is actuated in response to a pressure differential between a well annulus above the packer and an internal pressure in the tool. The sampler includes a plurality of sampler modules disposed in the sampling chamber. Each of the sampler modules includes a valve which automatically closes after a predetermined volume of fluid fills a sampler module chamber defined in the sampler module. Testing gauges may be disposed in the sampler adjacent the sampler modules. A shear pin holds the operating piston and sampler valve in a first closed position as the tool in run into the hole, and a locking dog assembly is used to lock the operating piston and sampler in a second closed position after the sampling chamber has been filled. A method of using the perforate, test and sample tool is also disclosed.

20 Claims, 13 Drawing Sheets

PERFORATE, TEST AND SAMPLE TOOL AND METHOD OF USE

This is a continuation of copending application Ser. No. 244,627 filed on Sept. 12, 1988, a continuation of application Ser. No. 064,285 filed June 19, 1987, both now abandoned.

BACKGROUND OF THE INVENTION

1. Field Of The Invention

This invention relates to tools used to sample fluids from a formation reservoir in a well, and more particularly, to a perforate, test and sample tool attached to the end of a tool string and having perforating guns, a packer and a sampler adapted for entrapping a fluid sample without flowing well fluids into the tool string.

2. Description Of The Prior Art

It is frequently necessary to obtain information about fluid in a well formation reservoir prior to actually producing the well. Measuring the pressure and temperatures of the fluid is important, but it is also desirable to obtain an actual sample of the fluid and bring that sample to the surface so that the physical characteristics of the fluid may be observed. As a result, numerous testing and sampling apparatus have been developed.

One such formation tester is disclosed in U. S. Pat. No. 2,169,559 to Halliburton, assigned to the assignee of the present invention. This apparatus includes a packer with perforating guns positioned therebelow and having a valve therein such that after the packer is set and the guns triggered, fluid from the well formation reservoir flows through the valve into a cylindrical body at the lower end of the tool string. When the drill string is raised, the valve recloses such that a volume of fluid is contained in the lower portion of the drill string. The drill string may be removed from the well bore and the sample drained for testing.

One problem with this apparatus and other sampling apparatus previously known is that hydrocarbons from the well formation are actually flowed into the tool string or to the surface. Because the formation is at a relatively high pressure, there is always a danger of a blowout of the well. Also, if sour gas is present in the sample fluid, special equipment is necessary on the surface and downhole for handling it.

The present invention solves these problems by providing a tool with a totally enclosed sampling chamber such that the hydrocarbons from the well formation reservoir are never flowed into the tool string and never flowed above the packer. Because the fluid sample is totally enclosed, the sampler may be handled at the surface, and a minimum of special equipment is needed for handling the fluids in the sampler even if the sample fluid contains sour gas.

Samplers adapted for obtaining a self-contained sample have been used on wire lines. In such apparatus, the tool is lowered on a wire line and perforating guns triggered and the sample chamber filled. Because the device is used on a wire line, it is not possible for a large fluid sample to be obtained. The present apparatus which is lowered on a tool string obviously has no such weight limitations. Also, wire line sampling devices are not totally reliable and frequently the sample obtained is less than desirable.

Summary Of The Invention

The perforate, test and sample tool of the present invention is adapted to be connected to the end of a tool string and is used in a well bore for sampling fluids from a formation reservoir. The tool comprises packer means sealingly engageable with the well bore, perforation means for perforation of the well bore and for allowing formation fluids to flow into a well annulus defined between the tool and the well bore below the packer means, sampling means for entrapping a sample of the formation fluid for subsequent removal of the sample from the well bore wherein the sample is isolated from the tool string, and valve means for opening and closing the sampling means. The sampling means is self-contained and no portion of the fluids from the formation reservoir enter the tool string. Preferably, the sampling means is positioned below the packer means so that the formation fluids are never above the packer means.

In one preferred embodiment, the valve means is opened and closed in response to a pressure differential between an internal pressure in the tool and a pressure in a portion of the well annulus above the packer means. However, the valve means may also be opened and closed by physical manipulation.

The tool further comprises clean-up means for collecting debris resulting from the perforation and mud filtration of the reservoir prior to opening of the valve means. In the preferred embodiment, the perforation means is characterized by a perforating gun defining fluid flow passages therethrough after firing thereof, and the clean-up means is characterized by an empty casing portion disposed below the gun and in fluid communication with the fluid flow passages in the gun such that fluid, debris and mud flow into the well casing portion after firing of the gun. It is only after this occurs that the valve means in the sampling means is opened.

Shear means are preferably provided for holding the valve means in a first closed position prior to opening of the valve means, and locking means are provided for locking the valve means in a second closed position after closure of the valve means.

The tool further comprises gauge means for measuring and recording at least one of a fluid pressure and a fluid temperature in the sampling means.

In a preferred embodiment, the sampling means is characterized by a fluid sampling apparatus comprising elongated body means defining a sampling chamber therein and sampler port means in communication with the sampling chamber which is opened and closed by the valve means, and modular sampling means disposed in the sampling chamber and adapted for separately entrapping a volume of fluid as the sampling chamber fills when the sampler port means is opened by the valve means. Preferably, second modular sampling means are also disposed in the sampling chamber longitudinally spaced from the first mentioned modular sampling means. The second modular sampling means is adapted for entrapping another volume of fluid as the sampling chamber fills.

Drain means are also provided on the body means for draining the sampling chamber when the apparatus is removed from a well bore, and in a preferred embodiment, two such longitudinally spaced drain means are used.

Gauge means are positioned in the sampling chamber adjacent the modular sampling means for measuring and recording at least one of a fluid pressure and temperature in the sampling chamber.

The modular sampling means comprises metering valve means openable in response to fluid pressure in the sampling chamber and metering means for automatically closing the metering valve means when a predetermined volume of fluid is in the modular sampling means. The metering means restricts movement of the metering valve means such that closure of the metering valve means prior to filling the modular sampling means to the predetermined volume is prevented.

The method of using the tool of the present invention for sampling fluid from the well formation reservoir comprises the steps of positioning the tool in the well bore, setting the packer such that the well annulus is defined thereabove and therebelow, actuating the gun for perforating the formation, opening the sampler valve in the self-contained sampler, filling the sampler with a predetermined volume of formation fluid from the well annulus below the packer, closing the sampler valve, unsetting the packer, removing the tool from the well bore, and draining the fluid from the sampler. In the embodiment of the tool wherein the sampler valve is pressure responsive, the step of opening the sampler valve comprises lowering pressure in the well annulus above the packer such that a pressure differential opens the sampler valve. The step of closing the sampler valve comprises raising pressure in the well annulus above the packer and lowering pressure in the tool so that a reverse pressure differential closes the sampler valve.

The method also may comprise the steps of positioning at least one sampler module in the sampler and filling the sampler module with a separate volume of formation fluid.

The method further comprises, prior to opening the sampler valve, the step of entrapping debris resulting from the perforation and mud filtration of the reservoir in a casing portion below the gun. Preferably, the method also comprises locking the sampler valve in a closed position after closure thereof and measuring and recording at least one of a temperature and a pressure in the sampler during filling thereof.

An important object of the invention is to provide a perforate, test and sample tool for obtaining a fluid sample from a well formation reservoir without flowing well fluids into the tool string.

Another object of the invention is to provide a tool for obtaining a well formation fluid sample without flowing the fluid above a packer in the tool string.

A further object of the invention is to provide a perforate, test and sample tool having a sampler with a valve therein which is opened in response to a differential between an internal pressure in the tool and a well annulus pressure.

Another object of the invention is to provide a sampling tool having a self-contained sampler.

Still another object of the invention is to provide a sampling tool having at least one individual sampler module for obtaining a well fluid sample.

Additional objects and advantages of the invention will become apparent as the following detailed description of the preferred embodiment is read in conjunction with the drawings which illustrate such preferred embodiment.

BRIEF DESCRIPTION Of The Drawings

FIGS. 2A–2K illustrate a partial cross section and partial elevation o the perforate, test and sample tool of the present invention as it is run into the well bore.

DETAILED DESCRIPTION OF THE PREFERRED EMBODIMENT

Figure 1A:
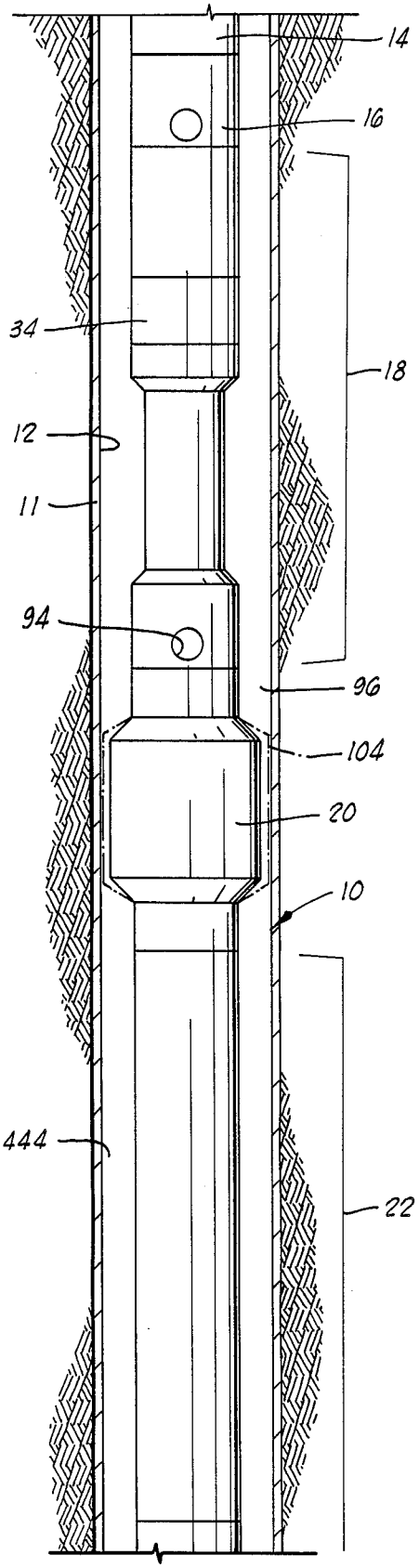
FIGS. 1A and 1B show the perforate, test and sample tool of the present invention in position in a well bore.
Figure 1B:
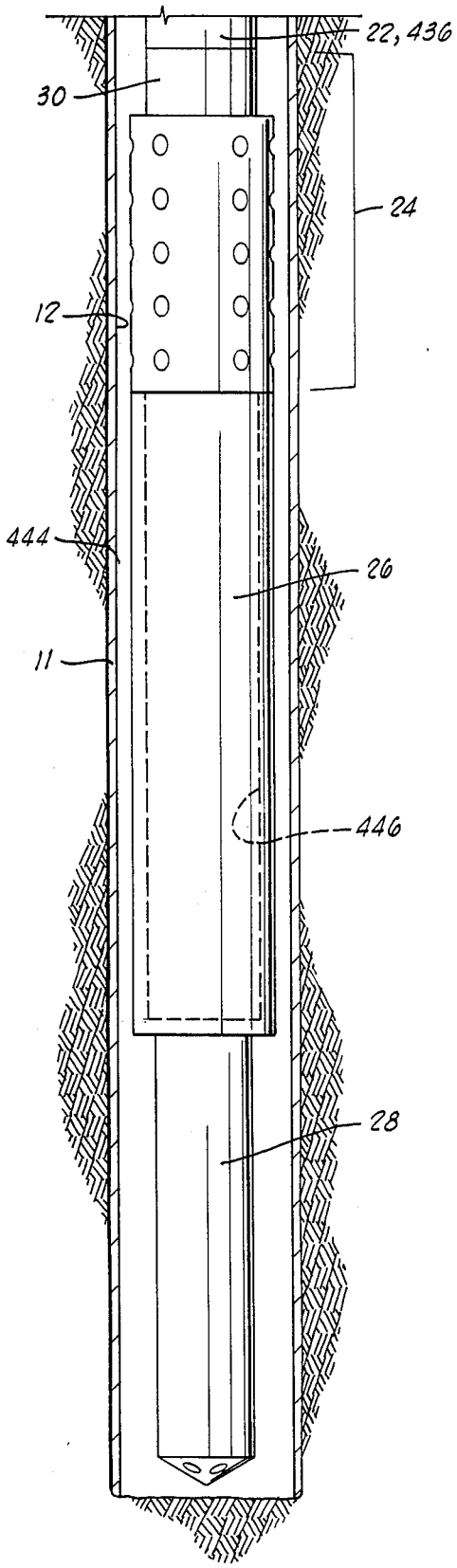

Referring now to the drawings, and particularly to FIGS. 1A and 1B, the perforate, test and sample tool of the present invention is shown and generally designated by the numeral 10. Tool 10 is positioned in a well casing 11 defining a well bore 12 at the end of a tool string 14. A circulating valve 16 of a kind known in the art is located above tool 10 in tubing string 14.

The major components of tool 10 include an upper piston sub 18, a packer 20 of a kind known in the art, a sampler 22, live perforating guns 24, blank guns 26 and a bundle gauge carrier 28 of a kind known in the art.

Circulating valve 16 is of a kind known in the art such as the Full-flow® hydraulic circulating valve, manufactured by the assignee of the present invention.

Packer 20 is also of a kind known in the art such as the Halliburton Champ® III retrievable packer, manufactured by the assignee of the present invention. This packer ss set by rotating tool string 14 and setting down weight. The packer is released by an upward pull.

Live guns 24 are also of a kind known in the art such as used in the Vanngun, manufactured by Vann Engineered Well Completions, a subsidiary of the assignee of the present invention. Live guns 24 include a firing head 30 such as the GEO® Vann firing head, and gun portion 32.

Figure 2A:
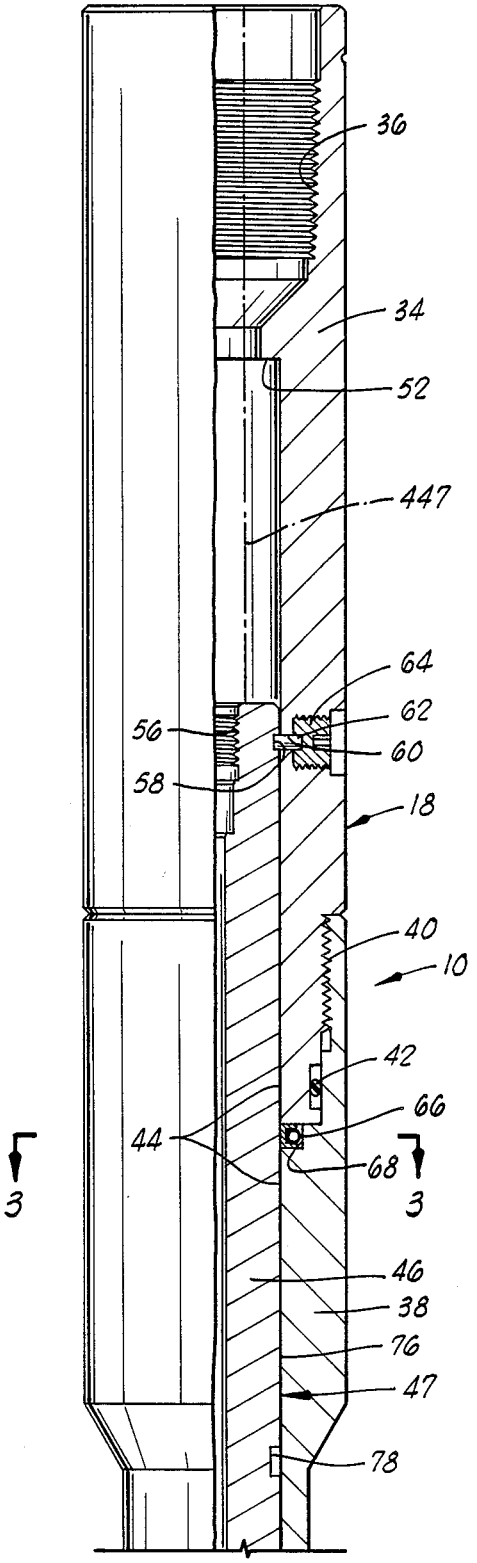

Referring now to FIGS. 2A–2K, details of tool 10 as the tool is run into well bore 12 are shown. In FIG. 2A, the upper end of piston sub 18 includes an upper adapter 34 with a threaded upper end 36 adapted for engagement to tool string 14. The lower end of upper adapter 34 is attached to an operating sub or cylinder 38 at threaded connection 40. A seal 42 seals between upper adapter 34 and cylinder 38.

Figure 2B:
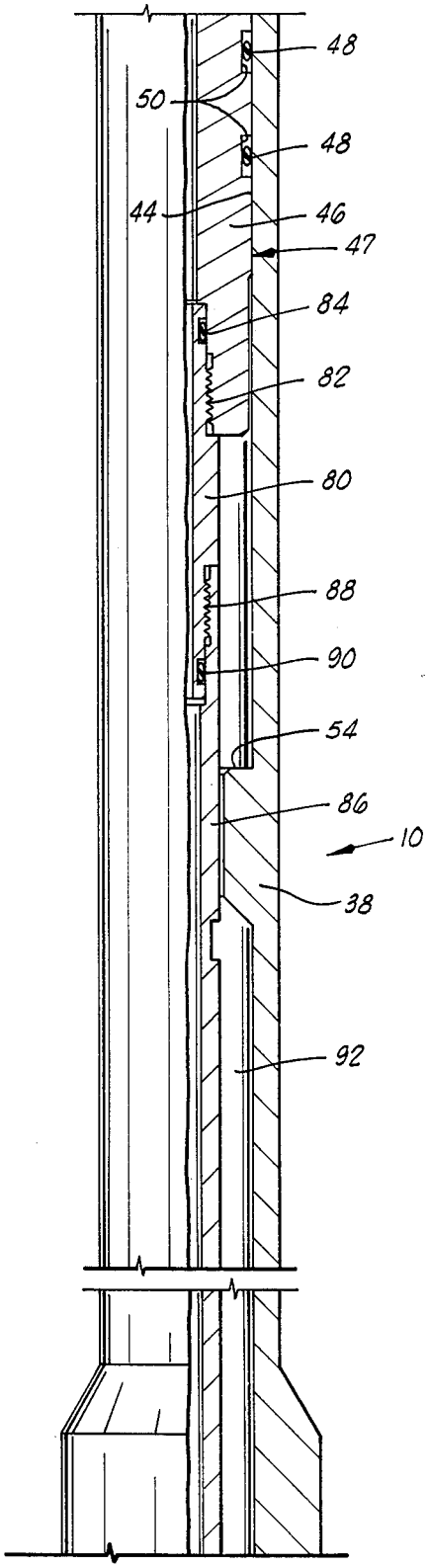

Referring also to FIG. 2B, it will be seen that upper adapter 34 and cylinder 38 define a longitudinal cylinder bore 44 therein. A piston means, such as an operating piston 46, is slidably disposed in cylinder bore 44. Operating piston 46 is the upper end of an inner tubing string 47 which extends longitudinally substantially the length of tool 10. Sealing means, such as piston rings 48 carried in piston ring grooves 50 on operating piston 46, provide sealing between the piston means and cylinder bore 44.

An upper annular shoulder 52 in upper adapter 34 and an lower annular shoulder 54 in cylinder 38 provide means for limiting the vertical movement of piston 46 as will be further discussed herein.

Referring back to FIG. 2A, the upper end of operating piston 46 has a threaded inner portion 56 and an external annular groove 58. A transverse hole 60 in upper adapter 34 has a shear pin 62 positioned therethrough such that the shear pin extends into annular groove 58 in piston 46. A plug 64 prevents communication between cylinder bore 44 and the outside of tool 10. Thus, in the position shown in FIGS. 2A–2K, shear pin 62 provides a means for holding piston 46 in the position shown such that undesired vertical movement of operating piston 46 and of the components attached thereto is prevented. These other components include sampler valve means described in detail herein. A locking dog assembly 66 is positioned in annular groove 68 of cylinder 38. As seen in FIG. 3, locking dog assembly 66 preferably comprises three locking dogs 70 of arcuate configuration having an outwardly facing groove 72 therein. A biasing means, such as garter spring 74, is positioned in groove 72 around each of locking dogs 70. It will be seen that spring 74 biases locking dogs 70 inwardly toward outer surface 76 of piston 46. Referring once again to FIG. 2A, outer surface 76 of piston 46 defines an outwardly facing annular groove 78 therein. Annular groove 78 is adapted for receiving locking dogs 70 of locking dog assembly 66, provided locking means for vertically locking operating piston 46 and the components attached thereto as will be described in more detail herein.

Referring again to FIG. 2B, the upper end of an inner ripple 80 is connected to the lower end of piston 46 at threaded connection 82. A seal provides sealing engagement between piston 46 and nipple 80.

The lower end of nipple 80 is connected to an inner sealing tube 86 at threaded connection 88. A seal 90 provides sealing engagement between nipple 80 and tube 86. Tube 86 extends downwardly through cylinder 38 such that an annular volume 92 is defined therebetween.

Figure 2C:
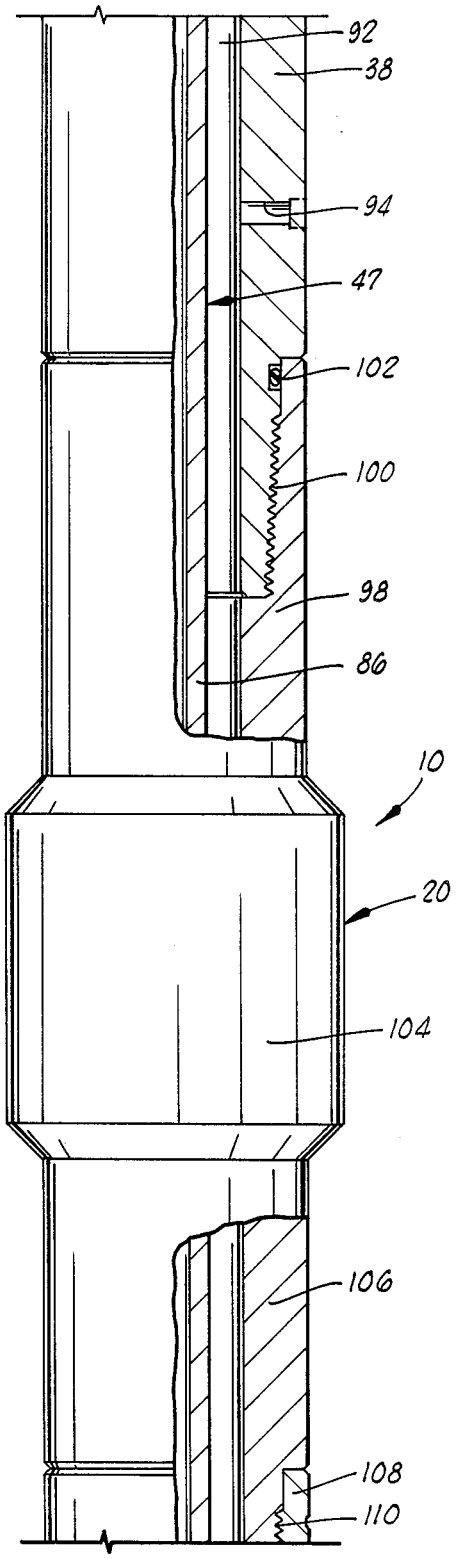
Figure 3:
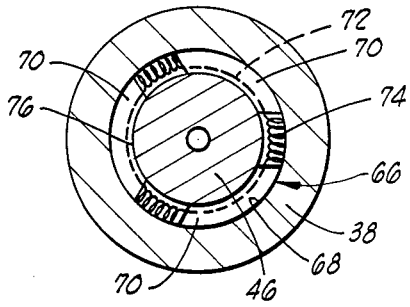
FIG. 3 a transverse cross section taken along lines 3—3 in FIG. 2A.

Referring now to FIG. 2C, a lower portion of cylinder 38 defines port means, best characterized by a plurality of annulus pressure ports 94 transversely therethrough, which provide communication between annular volume 92 and a well annulus 96 defined between tool 10 and well bore 12 above packer 20, as indicated in FIG. 1A.

Upper packer body 98 of packer 20 is connected to the lower end of cylinder 38 at threaded connection 100 with a seal 102 providing threaded engagement therebetween. Packer 20 also includes a packer element 104 expandable for engagement with well bore 12 and a lower packer body 106.

Figure 2D:
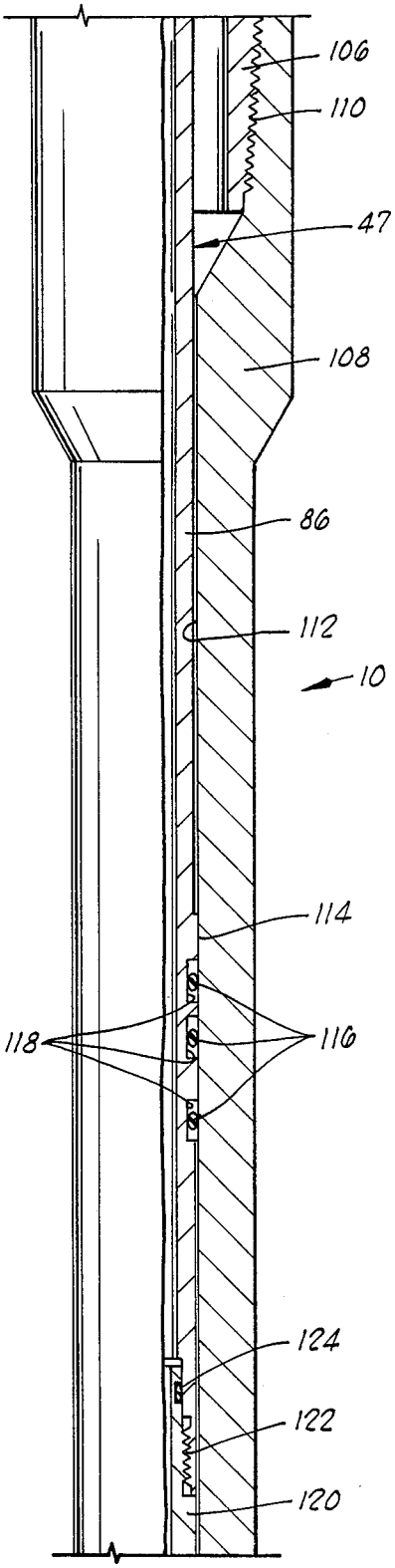

Referring also to FIG. 2D, the lower end of lower packer body 106 is connected to the upper end of sealing sub 108 at threaded connection 110.

Sealing sub 108 defines an inner bore 112 longitudinally therethrough. Sealing tube 86 has an outwardly extending seal portion 114 thereon which is adapted to be in close, sliding relationship with bore 112. Sealing means, such as piston rings 116 carried in piston ring grooves 118 in seal portion 114, provide sealing engagement between seal portion 114 and bore 112 in sealing sub 108. It will be seen that the sealing means seals the lower end of annular volume 92. It will also be seen that seal portion 114 is adapted to slide within bore 112 when operating piston 46 is moved within cylinder bore 44.

The lower end of sealing tube 86 is connected to a nipple 120 at threaded connection 122, and a seal 124 provides sealing engagement between nipple 120 and sealing tube 86.

Figure 2E:
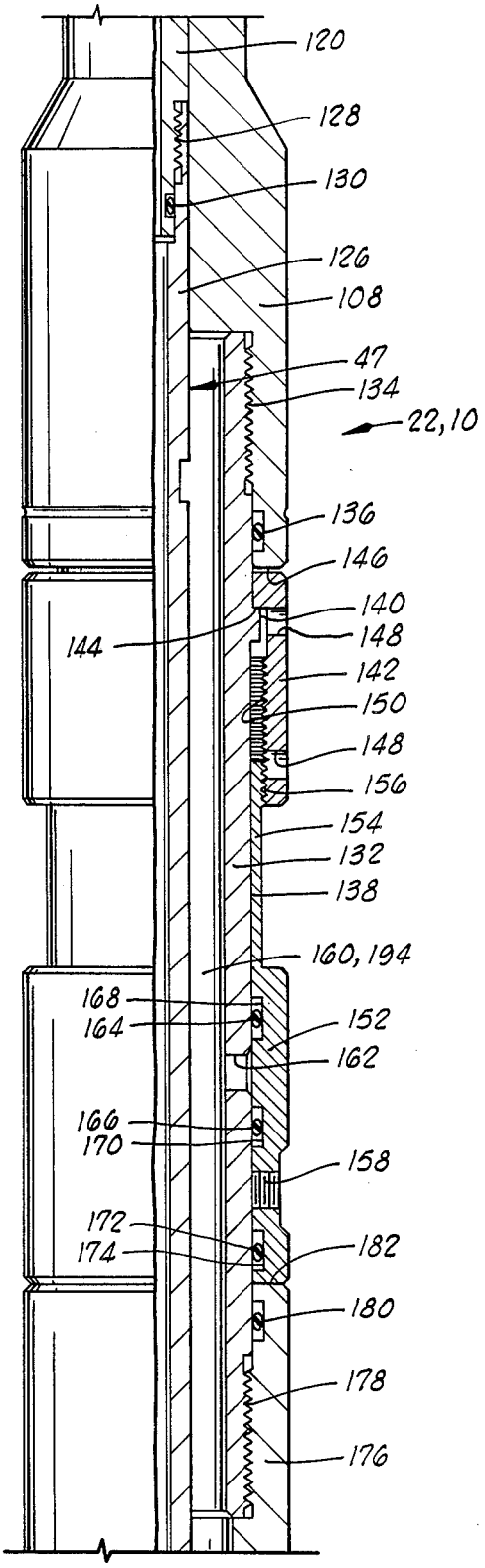

Referring now to FIG. 2E, nipple 120 is connected to inner tube 126 at threaded connection 128. A seal 130 provides sealing engagement between nipple 120 and tube 126.

The lower end of sealing sub 108 is connected to the upper end of upper sampler drain case 132 at threaded connection 134 with a seal 136 providing sealing engagement between the sealing sub and the upper sampler drain case.

Upper sampler drain case 132 has an outer surface 138 with an annular flange 140 extending outwardly therefrom. Annularly positioned around a portion of outer surface 138 adjacent flange 140 is a drain nut 142 having an annular inner shoulder 144 adapted to bear against the upper side of flange 140. It will be seen that nut 142 is substantially longitudinally fixed between flange 140 and lower face 146 of sealing sub 108. However, nut 142 is free to rotate about upper sampler drain case 132. Nut 142 defines a plurality of transverse holes 148 therethrough and also has a threaded inner surface 150 below annular shoulder 144.

Below nut 142 and annularly positioned around upper sampler drain case 132 is an upper sampler drain valve 152. Upper sampler drain valve 152 has a sleeve 154 which extends upwardly and has an externally threaded portion 156 threadingly engaged with threaded inner surface 150 of nut 142. Upper sampler drain valve 152 defines a threaded transverse hole 158 therein.

Tube 126 extends through upper sampler drain case 132 such that an annular cavity 160 is defined therebetween. As will be more fully explained herein, cavity 160 forms the upper portion of a sampling chamber 194 within sampler 22. It will be seen that seals 118 provide a sealing means for sealing the upper end of cavity 160 and sampling chamber 194.

Upper sampler drain 132 defines a transverse hole 162 therethrough in communication with cavity 160. As shown in FIG. 2E, upper sampler drain valve 152 is positioned such that seals 164 and 166, disposed in grooves 168 and 164, respectively, seal off hole 162 and prevent communication between cavity 160 and the well annulus. Another seal 172 is carried in another groove 174 in upper sampler drain valve 152. Seal 172 is positioned below hole 158 in drain valve 152. As will be discussed in more detail herein, drain valve 152 may be moved upwardly such that hole 158 is aligned with hole 162, thereby providing a drain means for allowing fluid communication between cavity 160 and the exterior of tool 10. The lower end of upper sampler drain case 132 is connected to a drain adapter 176 by threaded connection 178. Seal 180 provides sealing engagement between upper sampler drain case 132 and drain adapter 176. In the closed position of upper sampler drain valve 152 shown in FIG. 2E, it will be seen that the upper sampler drain valve is positioned adjacent upwardly directed face 182 of drain adapter 176.

Figure 2F:
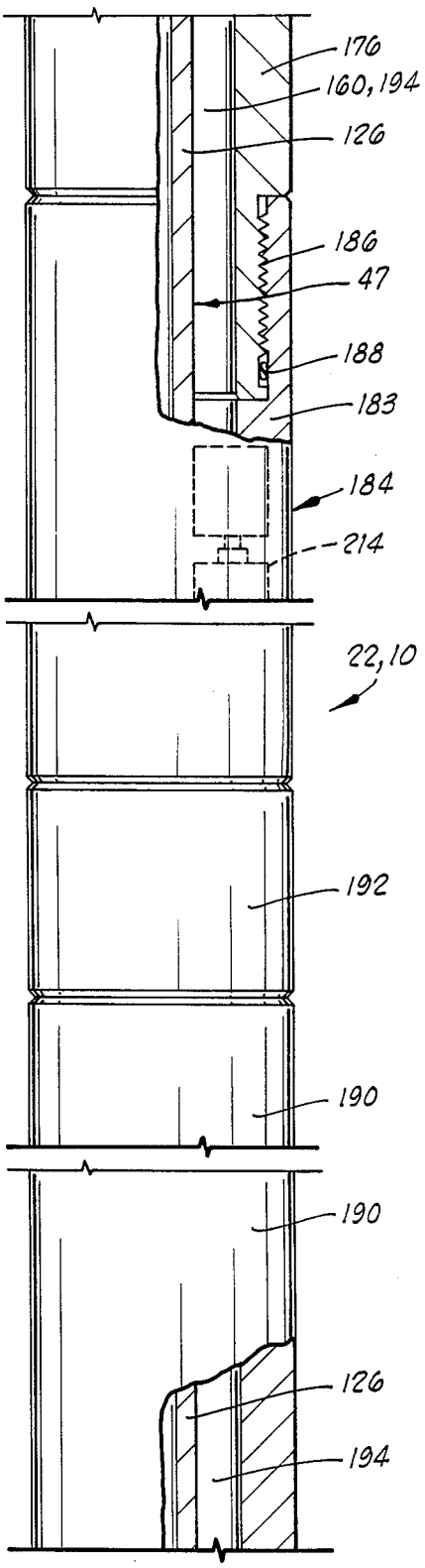

Referring now to FIG. 2F, drain adapter 176 is connected to sampler body 183 of upper sampler-gauge assembly 184 at threaded connection 186, and a seal 188 provides sealing engagement therebetween. The lower end of upper sampler-gauge assembly 184 is connected to hollow casing 190 by a coupling 192 in a manner known in the art. Tube 126 extends down through sampler 22 defining sampling chamber 194 therebetween, of which cavity 160 is an upper portion. Tube 126 may be a single piece or it may be formed of a plurality of pieces connected together in any known manner.

Figure 2G:
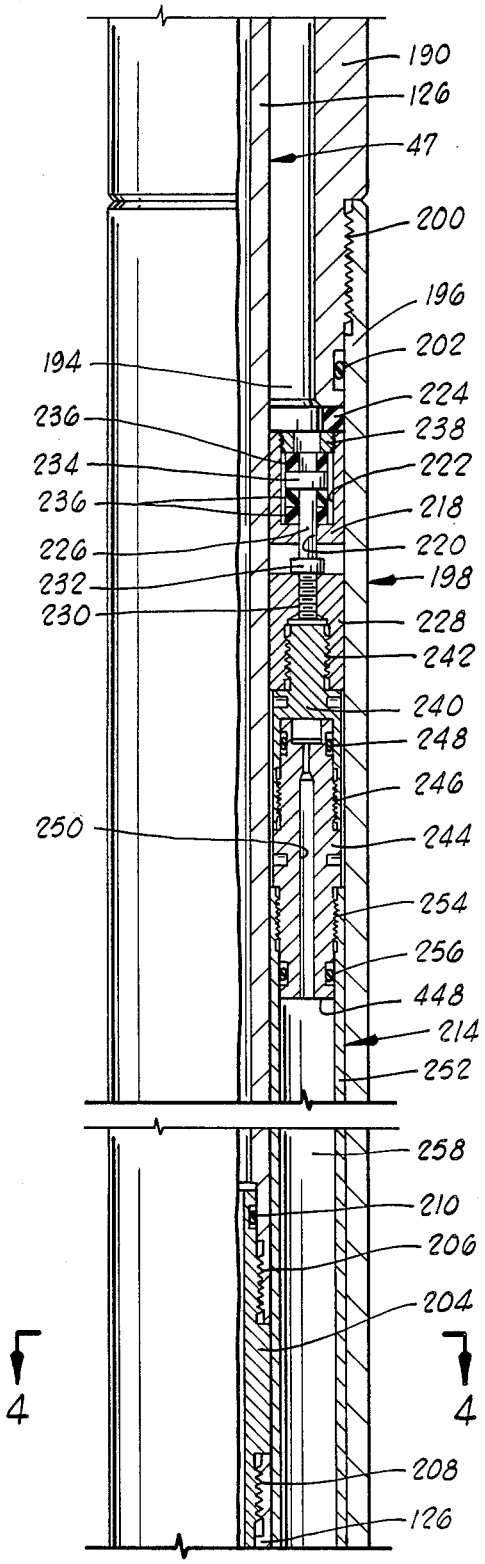

Referring now to FIG. 2G, casing 190 is connected to sampler body 196 of lower sampler-gauge assembly 198 at threaded connection 200. A seal 202 provides sealing engagement between coupling 190 and sampler body 196.

The construction of lower sampler-gauge assembly 198 will now be discussed in detail. It should be understood that upper sampler-gauge assembly 184 is of substantially identical construction and for this reason the details of the upper sampler-gauge assembly have not been shown. It should also be understood that the number of casings 190 and the necessary couplings 192 to connect them together may be varied as desired to arrive at a predetermined volume of sampling chamber 194.

Figure 2H:
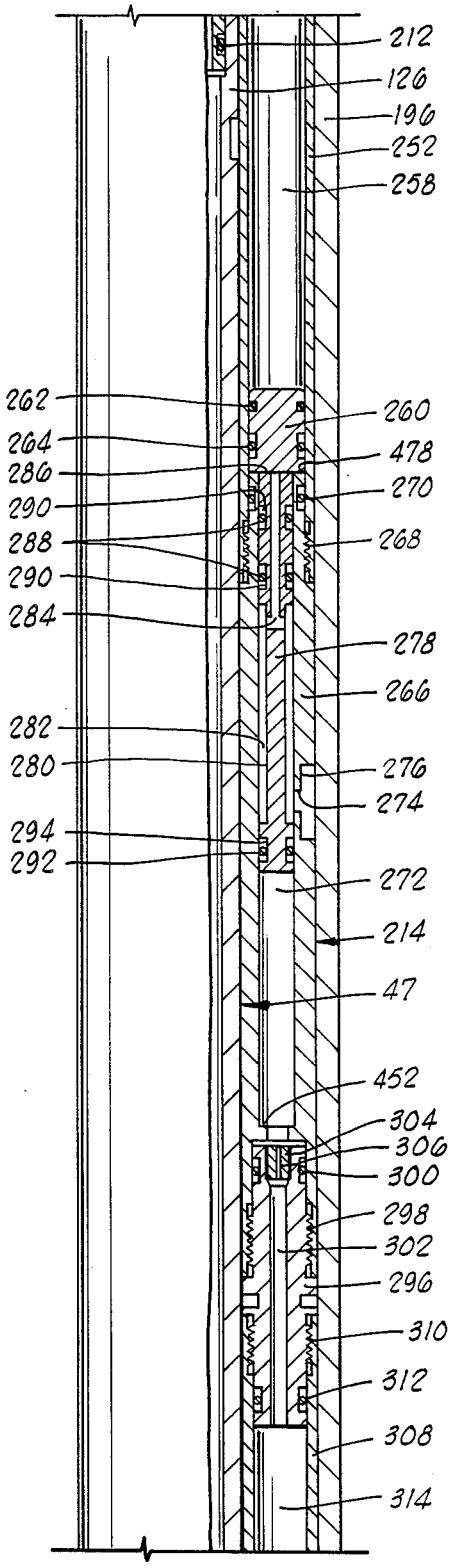
Figure 21:
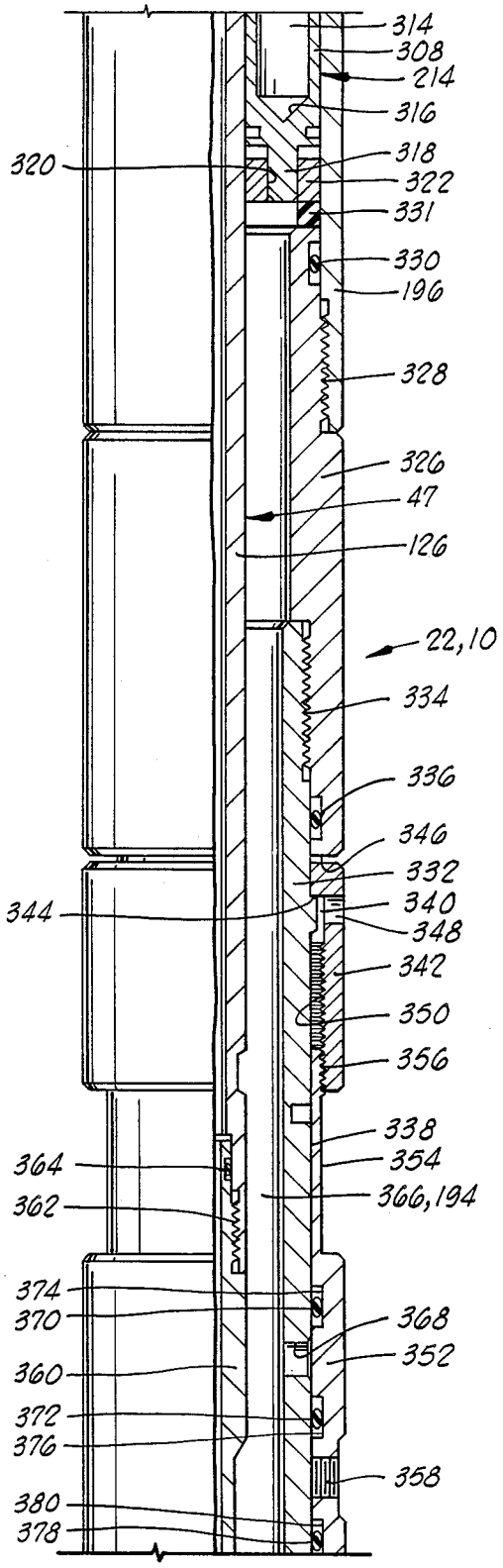

Sampler body 196 of lower sampler-gauge assembly 198 is a substantially tubular member and tube 126 extends therethrough. As already indicated, tube 126 may be of multi-piece construction such as a plurality of tubes 126 interconnected by couplings 204 at threaded connections 206 and 208 with sealing provided by seals 210 and 212 as shown in FIGS. 2G and 2H.

Figure 4:
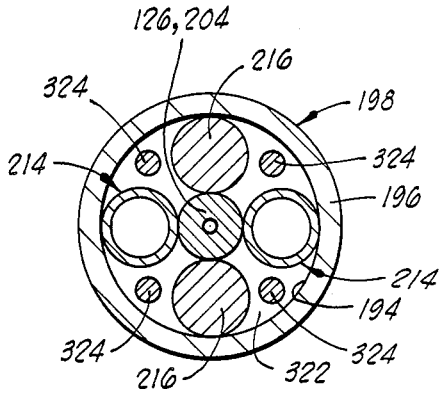
FIG. 4 shows a transverse cross section taken along lines 4—4 in FIG. 2G.

Referring now to FIGS. 2G and 4, modular sampling means preferably characterized by a pair of elongated sampler modules 214 are longitudinally positioned in annular sampling chamber 194 between sampler body 196 and tube 126. Preferably, sampler modules 214 are spaced at approximately 180°. Also longitudinally positioned in sampling chamber 194 are a pair of elongated testing gauges 216. Testing gauges 216 are of a kind known in the art and provide gauge means for measuring and recording pressure and/or temperature. Sampler modules 214 and testing gauges 216 have substantially the same external dimensions and are installed in substantially the same way. The actual internal details of testing gauges 216 are not necessary for this disclosure and are omitted for simplicity. As shown in FIG. 4, testing gauges 216 are preferably spaced approximately 90° from adjacent sampler modules 214.

Referring again to FIG. 2G, the upper end of each sampler module 214 (and also of each testing gauge 216) is supported by upper support means comprising an annular support ring 218 defining a plurality of holes 220 with corresponding concentric countersinks 222 thereabove. In the preferred embodiment, there are four such pairs of holes 220 and countersinks 222, one set for each sampler module 214 and each testing gauge 216, although the number of modules and gauges may vary as desired. Support ring 218 is separated from the bottom of the lowermost casing 190 by annular large cushion 224.

The upper support means also comprises a hanger 226 extends downwardly through hole 220 and is connected to adapter 228 at threaded connection 230. A nut 232 locks hanger 226 to adapter 228. Hanger 228 has an enlarged head portion 234 positioned in countersink 222, and a small cushion 236 is positioned above the head portion and two small cushions 236 are positioned therebelow. A plug 238 keeps head portion 234 and cushions 236 in place within countersink 222.

A drain cover 240 is connected to adapter 228 at threaded connection 242 and connected to drain nipple 244 at threaded connection 246. A seal 248 provides sealing engagement between drain cover 240 and drain nipple 244. A longitudinal passageway 250 is defined through drain nipple 244.

The lower end of drain nipple 244 is connected to sample case 252 at threaded connection 254 with a seal 256 providing sealing engagement therebetween. Sample case 252 defines an elongated central cavity 258 therein.

As seen in FIG. 2H, a piston 260 is originally disposed at the lower end of central cavity 258 in sample case 252. Sealing engagement is provided between piston 260 and sealing case 252 by upper piston ring 262 and lower piston ring 264.

A metering case 266 is connected to the lower end of sample case 252 at threaded connection 268. A seal 270 provides sealing engagement between metering case 266 and sample case 252.

Metering case 266 defines an elongated central cavity 272 therein with a transverse port or hole 274 in communication therewith. A countersink forms a flat shoulder 276 which extends adjacent hole 274.

Slidably disposed in central cavity 272 in metering case 266 is a metering valve 278. Metering.valve 278 has an elongated annular recess 280 thereon such that an annulus 282 is defined between metering valve 278 and the inner wall of metering case 266. In the position shown, annulus 282 is in fluid communication with transverse hole 274.

Metering valve 278 also defines a passageway 284 therein of substantially T-shaped cross section which extends from recess 280 at its lower end to top face 286 of metering valve 278 at its upper end. It will thus be seen that passageway 284 provides fluid communication between annulus 282 and the bottom of piston 260 and that annulus 282 and passagewa 284 provide passageway means between central cavity 258 in sealing case 252 and central cavity 272 in metering case 266. Above recess 280 a pair of spaced sealing rings 288 are carried on the exterior of metering valve 278 in ring grooves 290. The importance of the spacing between sealing rings 288 will become more apparent hereinafter. Another sealing ring 292 is carried in a groove 294 which is positioned below groove 280 on metering valve 278. It will thus be seen that the portion of central cavity 272 above sealing ring 292 is separated from the portion of central cavity 272 below sealing ring, 292.

The lower end of metering case 266 is connected to metering nipple 296 at threaded connection 298. A seal 300 provides sealing engagement between metering case 266 and metering nipple 296.

Metering nipple 296 defines a longitudinal passageway 302 therethrough with orifice means such as a Visco-jet 304 disposed across the upper end thereof. Visco-jet 304 is of a kind known in the art and has a small, precisely sized orifice 306 therethrough which provides restricted communication between the lower portion of central cavity 276 and metering case 266 and passageway 302.

The lower end of metering nipple 296 is connected to air chamber 308 at threaded connection 310 with a seal 312 providing sealing engagement therebetween. Air chamber 308 defines an elongated cavity 314 therein which is in communication with passageway 302 in metering nipple 296.

Referring now to FIG. 2I, cavity 314 in air chamber 308 has a closed lower end 316.

Air chamber 308 has a downwardly extending stud portion 318 which forms a lower portion of the air chamber. Stud portion 318 extends into a hole 320 defined in a lower guide plate 322. There are a plurality of holes 320, one for each sampler module 214 and each testing gauge 216. Lower guide plate 322 thus provides lower support means for sampler modules 214 and testing gauges 216.

Referring again to FIG. 4, a plurality of guide posts 324 provide additional support means extending longitudinally between guide plate 322 and support ring 218. Guide posts 324 are engaged with guide plate 322 and support ring 218 such that a rigid assembly is formed. This allows all of the sampler modules 214 and testing gauges 216 to be positioned in, and removed from, sampling chamber 194 at one time.

Referring again to FIG. 2I, the lower end of sampler body 196 is connected to lower drain adapter 326 at threaded connection 328. A seal 330 provides sealing engagement between sampler body 196 and drain adapter 326.

An annular cushion 331 separates guide ring 322 from the top of drain adapter 326.

The lower end of drain adapter 326 is connected to lower sampler drain case 332 at threaded connection 334 with seal 336 providing sealing engagement therebetween.

The entire drain valve assembly around lower sampler drain case 332 is substantially identical to that around upper sampler drain case 132. Lower sampler drain case 332 has an outer surface 338 with an annular flange 340 extending outwardly therefrom. Annularly positioned around a portion of outer surface 338 adjacent flange 340 is a drain nut 342 having an annular inner shoulder 344 adapted to bear against the upper side of flange 340. It will be seen that nut 342 is substantially longitudinally fixed between flange 340 and lower face 346 of drain adapter 326. However, nut 342 is free to rotate about lower sampler drain case 332. Nut 342 defines at least one transverse hole 348 therethrough and also has a threaded inner surface 350 below annular shoulder 344.

Below nut 342 and annularly positioned around lower sampler drain case 332 is a lower sampler drain valve 352. Lower sampler drain valve 352 has a sleeve 354 which extends upwardly and has an externally threaded portion 356 threadingly engaged with threaded inner surface 350 of nut 342. Lower sampler drain valve 352 defines a threaded transverse hole 358 therein.

Tube 126 continues to extend downwardly through sampler 22, and the lower end of tube 126 is connected to sampler valve means best characterized by sampler valve 360 at threaded connection 362. A seal 364 provides sealing engagement between tube 126 and valve 360.

An annular cavity 366 is thus defined between lower sampler drain case 332 and the assembly formed by tube 126 and valve 360. It will be seen that cavity 366 forms a lower portion of sampling chamber 194 within sampler 22.

Lower sampler drain case 332 defines a transverse hole 368 therethrough in communication with cavity 366. As shown in FIG. 2I, lower sampler drain valve 352 is positioned such that seals 370 and 372 disposed in grooves 374 and 376, respectively, seal off hole 368 and prevent communication between cavity 366 and the well annulus. Another seal 378 is carried in another groove 380 in lower sampler drain valve 352. Seal 378 is positioned below hole 358 in drain valve 352. As will be discussed in more detail herein, drain valve 352 may be moved upwardly such that hole 358 is aligned with hole 368, thereby providing drain means for allowing fluid communication between cavity 366 and the exterior of tool 10.

Figure 2J:
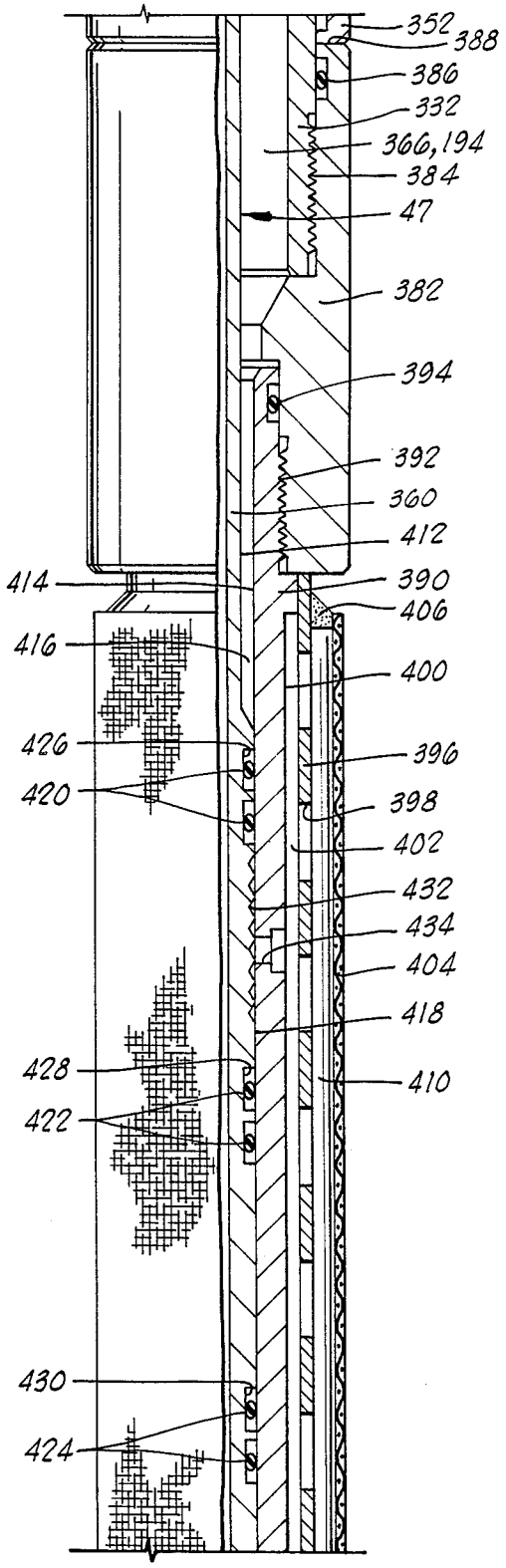

Referring now to FIG. 2J, the lower end of lower sampler drain case 332 is connected to a drain coupling 382 at threaded connection 384. Seal 386 provides sealing engagement between lower sampler drain case 332 and drain coupling 382. In the closed position of upper sampler drain valve 352 shown in FIGS. 2I and 2J, it will be seen that the sampler drain valve is positioned adjacent upwardly directed face 388 of drain coupling 382.

The lower end of drain coupling 382 is connected to the upper end of valve body 390 at threaded connection 392, with a seal 394 providing sealing engagement therebetween.

Annularly disposed around valve body 390 is a screen support 396 having a plurality of openings 398 therethrough. Valve body 390 has a recessed outer surface 400 spaced inwardly from screen support 396 such that an annular volume 402 is defined therebetween.

Figure 2K:
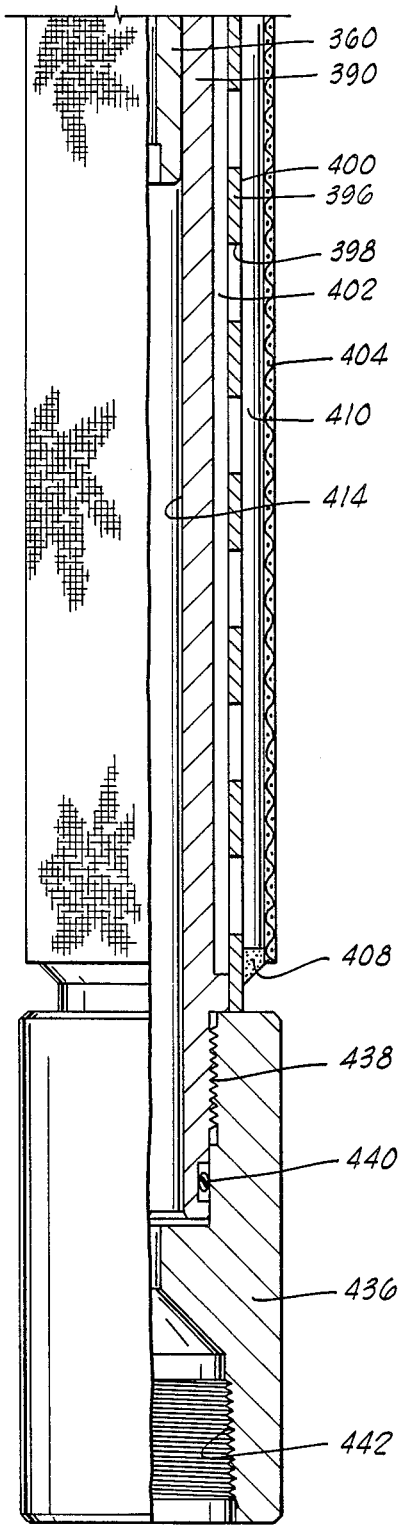

Annularly spaced outwardly from screen support 396 is a filter screen 404 which is attached at its upper end to screen support 396 by weld 406 and at its lower end to screen support 396 by weld 408, as seen in FIG. 2K. It will be seen that another annular volume 410 is defined between filter screen 404 and screen support 396.

Valve 360 has a first outer surface 412 spaced inwardly from inner surface 414 of valve body 390 such that an annular passageway 416 is defined therebetween. Valve 360 also has a second outer surface 418 adapted to be in close, spaced and sliding relationship with inner surface 414 of valve body 390. Upper valve seals 420, intermediate valve seals 422 and lower valve seals 424 are carried in grooves 426, 428 and 430, respectively, in outer surface 418 of valve 360. Thus, a means is provided for sealing engagement between valve 360 and inner surface 414 of valve body 390, as will be described in more detail herein.

Between upper valve seals 420 and intermediate valve seals 422, outer surface 418 of valve 360 has a serrated portion 432. Adjacent serrated portion 432, as shown in FIG. 2J, and transversely extending through screen mandrel 390 is a sampler port means, such as at least one sampler port 434. Serrated portion 432 acts as an indicator means, visible through sampler port 434, for indicating that valve 360 is properly positioned during assembly of tool 10.

Referring again to FIG. 2K, the lower end of valve body 390 is connected to a gun coupling or lower adapter 436 at threaded connection 438. A seal 440 provides sealing engagement between seal mandrel 390 and lower adapter 436. Lower adapter 436 has an internally threaded opening 442 which is adapted for engagement with firing head 30, as best shown in FIG. 1B.

A study of FIGS. 2A–2K will show that sealing sub 108, upper sampler drain case 132, drain adapter 176, sampler case 183, coupling 192, casing 190, sampler body 196, drain adapter 326, lower sampler drain case 332, coupling 382 and valve body 390 provide elongated body means, generally in the form of an annular outer body portion, for sampler 22.

OPERATION OF THE INVENTION

The components of tool 10 are in the configuration shown in FIGS. 2A–2K when the tool is run into well bore 12 at the end of tool string 14. In this run-in position of tool 10, metering chamber 272, shown in FIG.

2H, is filled with a viscous fluid such as oil. Air chamber 314, shown in FIGS. 2H and 2I, is initially empty. That is, air chamber 314 is originally filled with atmospheric air. Also initially empty is central cavity 258 in sample case 252, shown in FIGS. 2G and 2H.

Once tool 10 is positioned in well bore 12 at the desired location, as illustrated in FIGS. 1A and 1B, circulating valve 16 is closed and packer 20 is actuated as previously described such that packer element 104 sealingly engages well bore 12 as shown by phantom lines in FIG. 1A. Firing head 30 is then triggered, and gun portion 32 of live guns 24 fire to perforate casing 11 adjacent the formation to be sampled so that well fluids will flow from the formation. For the Vanngun previously mentioned, firing head 30 is triggered by pressurizing the well annulus and the internal portion of tool 10. However, other perforating guns may use manipulation of the tool string in addition to, or instead of, applying pressure. The invention is not intended to be limited to a particular type of perforating gun.

When packer 20 is engaged, a sealed well annulus 444 is defined around the portionsof tool 10 below packer 20, as shown in FIGS. 1A and 1B. When live guns 24 are fired, fluid enters blank guns 26 such that inner cavity 446 therein is filled with fluid, well debris and mud filtration of the reservoir. The majority of the debris resulting from perforation of well bore 12 and the mud filtration will either fall to the bottom of annulus 444 or go into cavity 446 rather than enter sampler 22 once the sampler subsequently is opened. Thus, a clean-up means is provided for cleaning well annulus 444 below packer 20 prior to opening sampler 22.

Figure 5A:
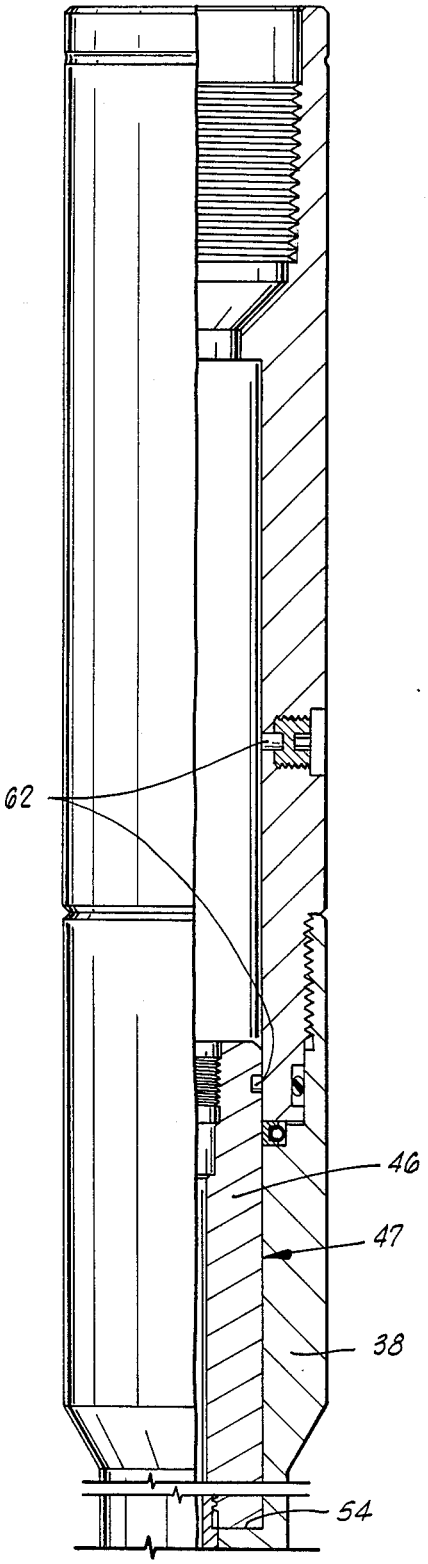
FIGS. 5A–5F show a partial elevation and cross section of a portion the tool after a sampler valve has been opened and a sample chamber filled.

When it is desired to take the fluid sample, pressure in well annulus 96 above packer 20 is lowered below the internal pressure in tool 10. When the well annulus pressure is lowered, it will be seen that the pressure in annular volume 92, best shown in FIGS. 2B and 2C, is lowered because annular volume 92 is in communication with well annulus 96 through annulus pressure ports 94. Consequently, inner string 47 is moved downwardly as shown in FIGS. 5A–5F by the downward force resulting from the pressure differential acting on operating piston 46 such that shear pins 62 are sheared. Operating piston 46 is thus moved downwardly until it contacts lower annular shoulder 54 in cylinder 38 as seen in FIG. 5A.

Although the above description of a pressure responsive operating piston 56 is a preferred embodiment, operating piston 46 could also be actuated by applying downward force on the piston through a tubing string 447 of a kind known in the art connected to threaded portion 56 at the upper end of the operating piston. The invention is not intended to be limited to a pressure actuated operating piston 46.

Figure 5B:
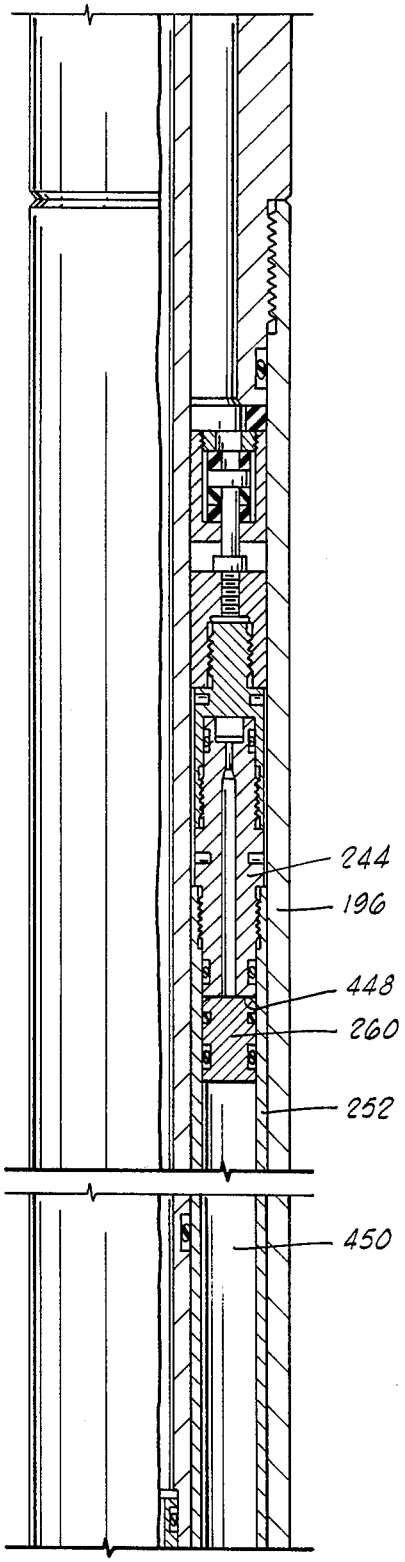
Figure 5C:
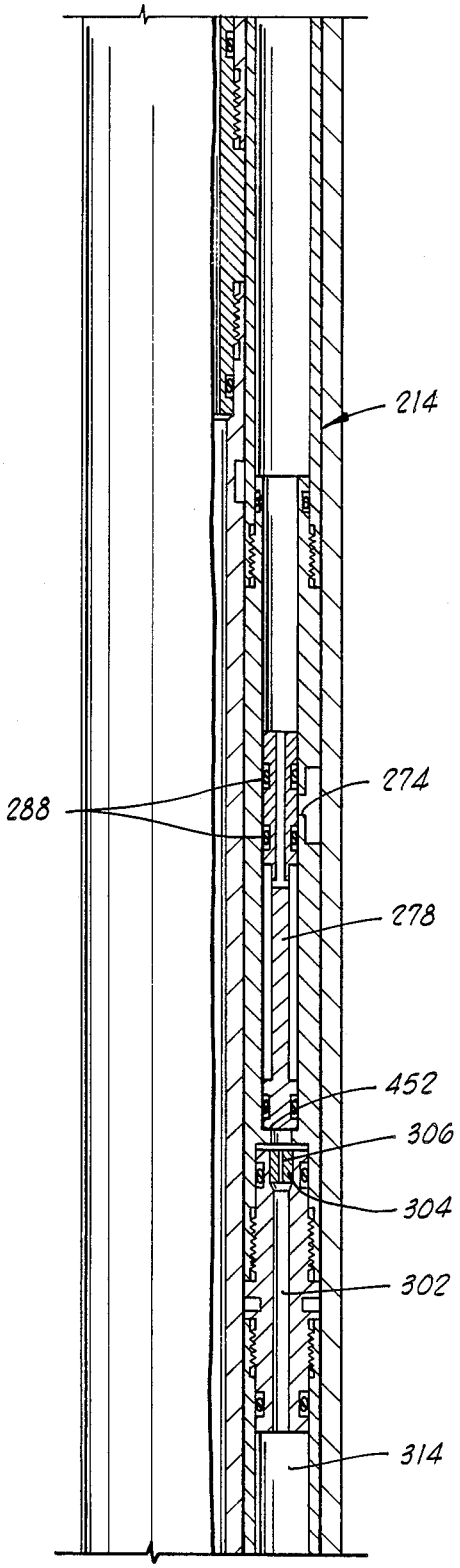
Figure 5D:
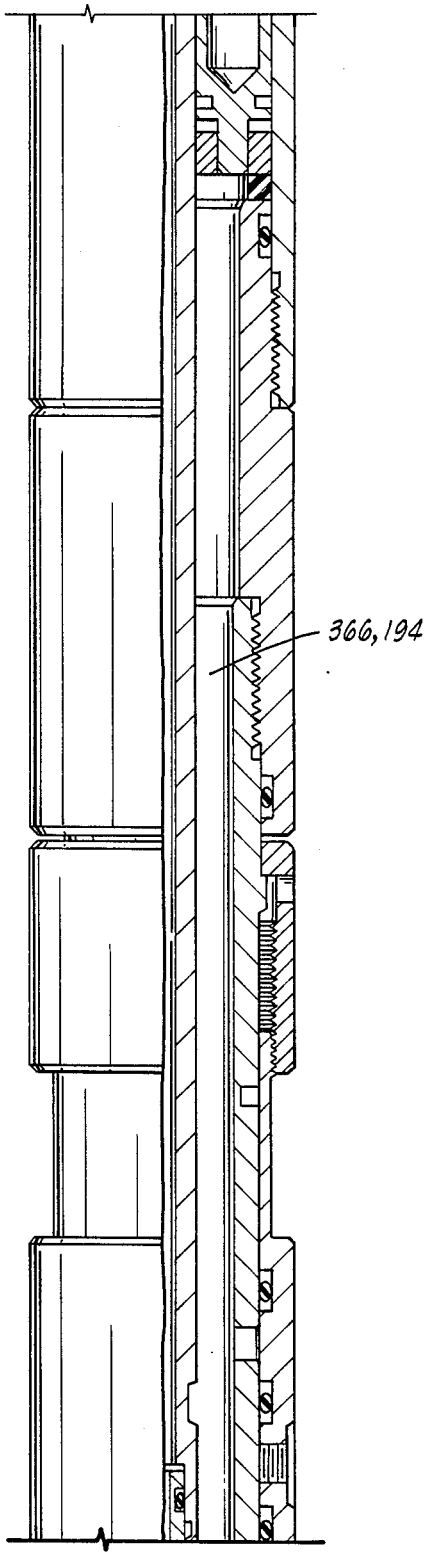
Figure 5E:
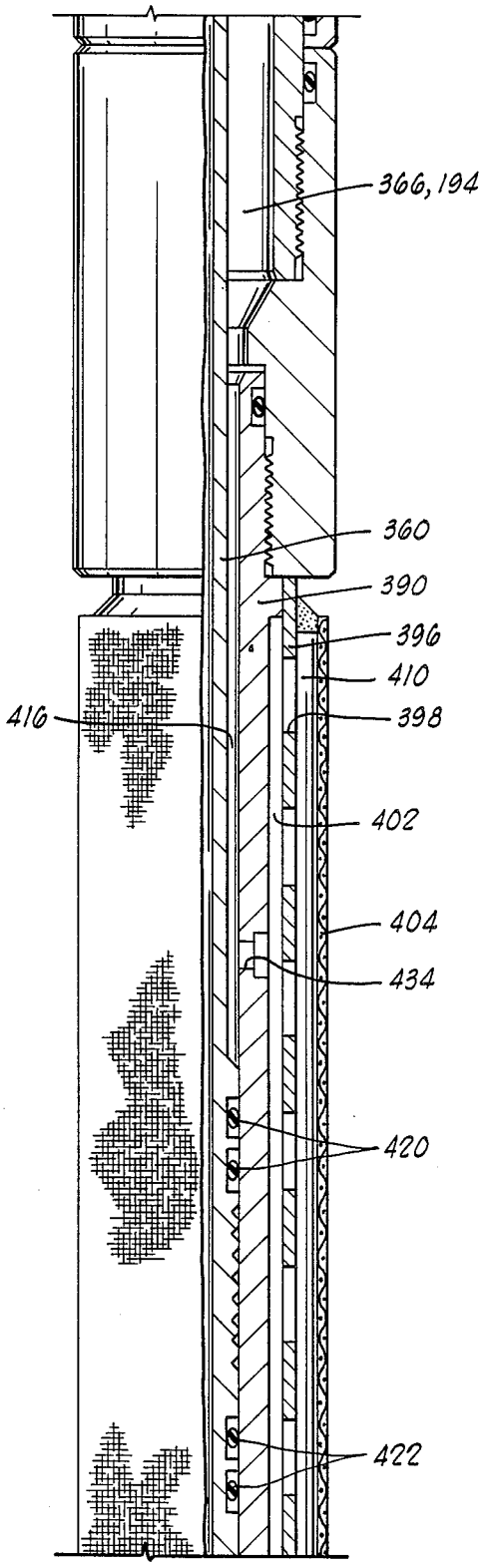
Figure 5F:
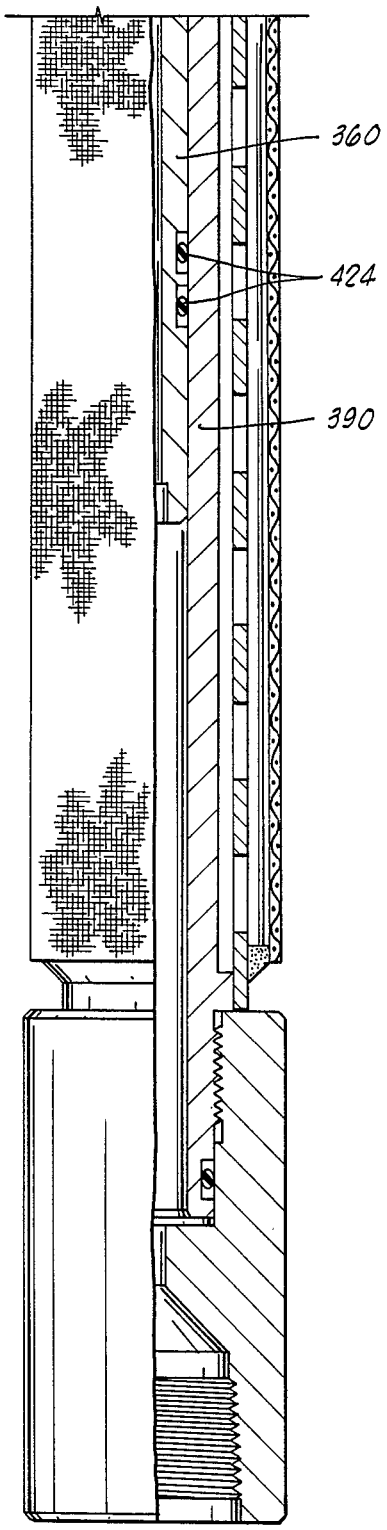

Referring now to FIG. 5E, regardless of how operating piston 46 is actuated, valve 360 is correspondingly moved downwardly within valve body 390 such that upper valve seals 420 are moved below sampler port 434, thus placing the sampler port in fluid communication with annular passageway 416 and therefore in communication with annular cavity 366, the lower potion of sampling chamber 194.

Well fluid in well annulus 444 enters sampler 22 through filter screen 404, flowing through annular volume 410, openings 398, annular volume 402, sampler port 434 and annular passageway 416 into sampling chamber 194. Sampling chamber 194 gradually fills, upwardly compressing the lower pressure air therein. Sampling chamber 194 thus provides a large volume of sample fluid when tool 10 is raised out of well bore 12.

Referring now to FIGS. 2G, 2H, 4, 5B and 5C, the filling of each sampler module 214 will be discussed. It will be seen that hole 274 in metering cse 266 is in fluid communication with, and actually forms a part of, sampling chamber 194. Thus, as sampling chamber 194 fills, fluid enters hole 274, flowing through the passageway means characterized by annulus 282 and passageway 284, coming in contact with the bottom of piston 260, as best seen in FIG. 2H. The fluid pressure forces piston 260 upwardly in central cavity 258 of sampler case 252, compressing the air in cavity 258. Piston 260 continues to move upwardly until it contacts lower face 448 of drain nipple 244, as best seen in FIG. 5B. Thus, a sampler module chamber 450 is defined below piston 260 in sampling case 252. Chamber 450 is filled with fluid which may then be drained once tool 10 is brought out of well bore 12.

It will be clear to those skilled in the art that the two sampler modules 214 in lower sampler-gauge assembly 198 fill before the corresponding sampler modules 214 in upper sampler-gauge assembly 184. Along with differences in the temperature and pressure, as measured by upper and lower testing gauges 216, the fluid samples in sample module 214 provide important information relating to the flow rate of the formation being tested, as well as the type of fluid in the formation which is essential for reservoir evaluation.

As piston 260 moves upwardly, filling sampler module chamber 450, fluid pressure also forces metering valve 278 downwardly in metering case 266. The oil present in metering chamber 272 provides resistance to this downward motion of metering valve 278, because the oil must pass through small orifice 306 in Visco-jet 304 before being discharged through passageway 302 into cavity 314 in air chamber 308. Eventually, metering valve 278 moves all the way downwardly until it contacts lower shoulder 452 in metering case 266, thus displacing all of the oil out of metering chamber 272 and compressing the air in air chamber 308.

By proper sizing of all of the components, complete downward movement of metering valve 278 does not occur until after complete upward movement of piston 260. In other words, sampler module chamber 450 is completely filled before metering valve 278 reaches shoulder 452. It will be seen that, once metering valve 278 has reached its downward-most position, sealing rings 288 close off hole 274 in metering case 266. Thus, once sampler module chamber 450 is completely filled with a sample fluid, sampler module 214 is closed. Thus, a metering means is provided for automatically closing the metering valve means when a predetermined fluid volume is in sampler module chamber 450.

Once metering chamber 194 and each sampler module chamber 450 are filled, it is necessary to close sampler port 434 prior to removing tool 10 from well bore 12. Referring now to FIGS. 6A–6D, closure of sampler port 434 is accomplished by lowering the internal pressure in tool 10 and repressurizing well annulus 96. It will seen that this causes an upward pressure differential on operating piston 46 resulting in an upward force which causes the piston to move upwardly until it contacts upper annular shoulder 52 of upper adapter 34. It will be noted that operating piston 46 is thus raised above its original position such that groove 72 is aligned with locking dog assembly 66. Garter spring 74 forces locking dogs radially inwardly such that they engage groove 72 locking operating piston 46, and thus inner string 47, into the position shown in FIGS. 6A-6D.

Once again, it is noted that the invention is not intended to be limited to a pressure responsive operating piston 46. Piston 46 could be raised by lifting on tubing string 447 connected to the operating piston at threaded portion 56 thereof.

As operating piston 46 is moved upwardly by either applying a pressure differential or lifting on a tubing string 447, valve 360 is also moved upwardly above its original position. In this newly raised position, intermediate valve seals 422 on valve 360 are located above sampler port 434. In this way, intermediate valve seals 422 and lower valve seals 424 sealingly close sampler port 434.

Because valve 360 is connected to operating piston 46, it will be seen that locking dog assembly 66 provides a means for locking valve 360 in a sealingly closed position.

After valve 360 is closed, packer 20 may be disengaged and circulating valve 16 reopened so that tooling string 14 and tool 10 may be retrieved from well bore 12.

Once tool 10 is out of the well bore, the test fluid in sampler 22 may be drained therefrom. First, draining the fluid from large sampling chamber 194 will be discussed.

Figure 6A:
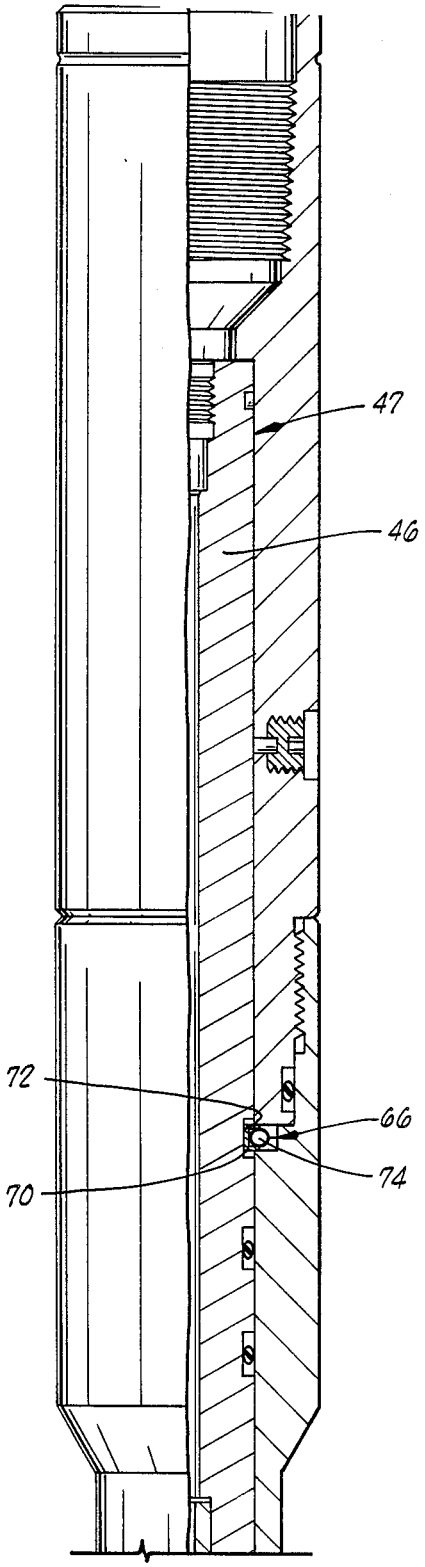
FIGS. 6A–6D a partial elevation and cross section of a portion of the tool after the sampler valve has been closed and the tool removed from the well bore and prepared for draining of the sample.
Figure 6B:
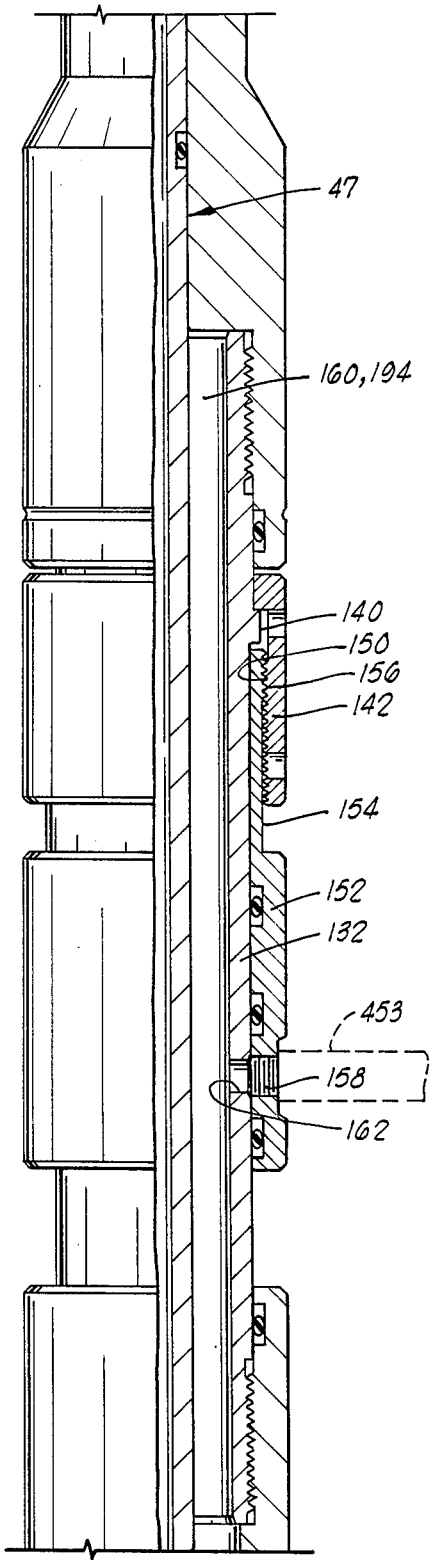

Referring to FIG. 6B, a drain line 453 with appropriate valving is connected to hole 158. Upper sampler drain valve 152 is then moved upwardly by rotation of nut 142. When sleeve 154 of upper sampler drain valve 152 contacts flange 140 on upper sampler drain case 132, hole 158 in upper sampler drain valve 152 is aligned with hole 162 in the upper sampler valve mandrel. Thus, cavity 160 which is the upper portion of sampler chamber 194 may be easily drained or vented.

Figure 6C:
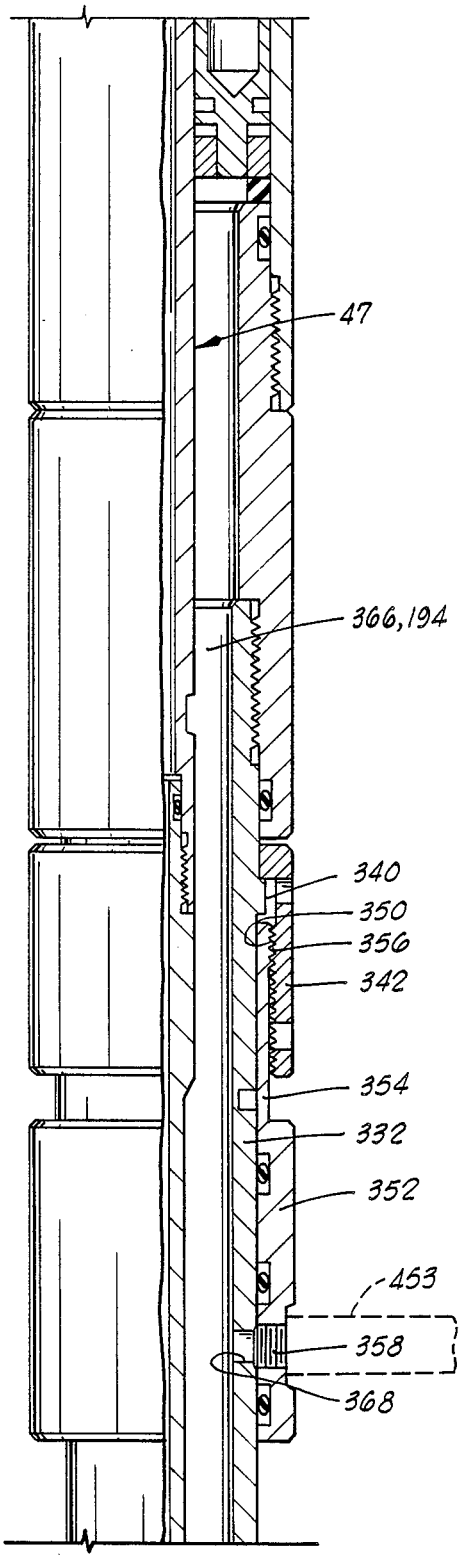
Figure 6D:
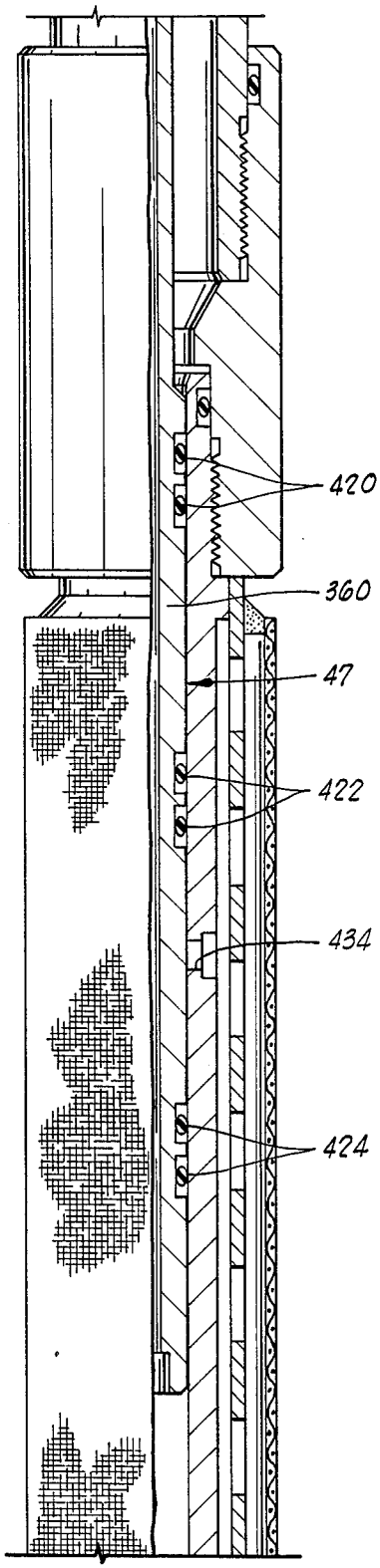

Referring now to FIG. 6C, another drain line 453 with valving is connected to hole 358 of lower sampler drain valve 352, and the lower sampler drain valve is raised by rotation of nut 342 until sleeve 354 contacts flange 340 on lower sampler drain case 332. When this occurs, hole 358 in lower sampler drain valve 352 is aligned with hole 368 in lower sampler valve mandrel 332 such that cavity 366 which is the lower portion of sampling chamber 194 may be drained or vented as desired.

Once sampling chamber 194 has been completely drained, sampler 22 may be disassembled such that each sampler module 214 may be removed therefrom and drained separately. Because each sampler module 214 is a self-contained unit, the sampler modules are easily transported and may be drained anywhere desired, such as in a testing laboratory.

Figure 7A:
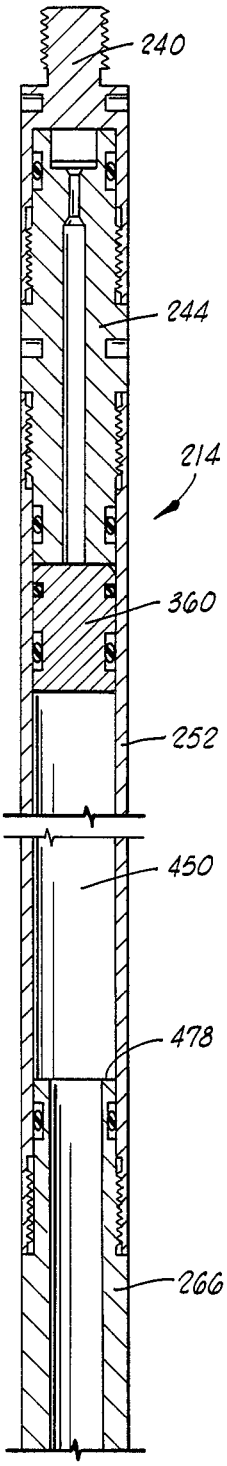
FIGS. 7B and 7B illustrate a sampler module in the tool after a chamber therein has been filled.
Figure 7B:
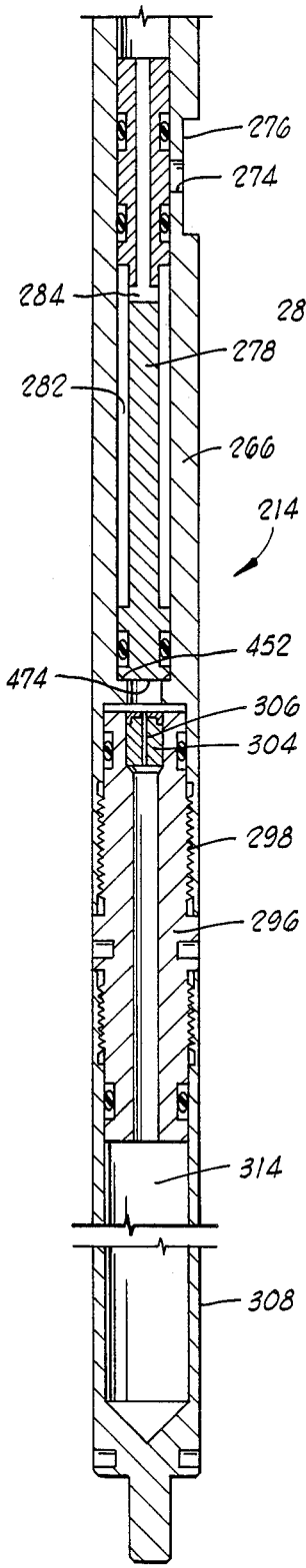
Figure 8:
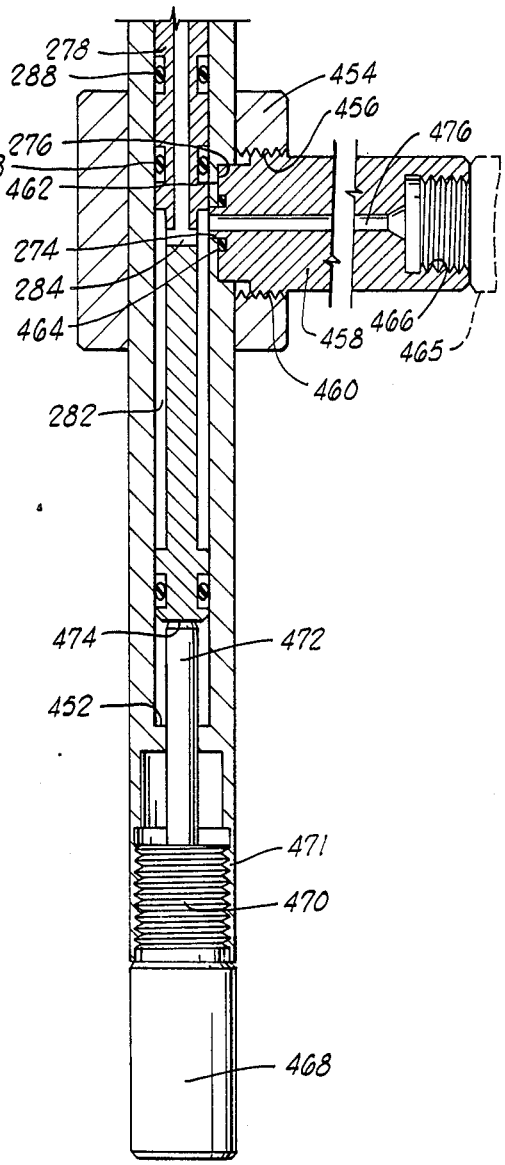
FIG. 8 illustrates a lower portion of the sampler module with a drain collar and nipple positioned thereon for draining of a fluid sample.

The draining of a typical sampler module 214 will now be discussed. Initially, of course, piston 360 and metering valve 278 are in the positions shown in FIGS. 7A and 7B with hole 274 sealingly closed. Referring also to FIG. 8, a drain collar 454 is annularly positioned around metering case 266 such that a threaded opening 456 in drain collar 454 is substantially aligned with hole 274 in metering case 266. A surface drain nipple 458 with an externally threaded surface 460 is threadingly engaged with threaded hole 456 in drain collar 454. Surface drain nipple 458 is threaded into drain collar 454 such that until inner face 462 of the surface drain nipple contacts annular shoulder 276 on metering case 266. A seal 464 provides sealing engagement between surface drain nipple 458 and shoulder 276. A drain line 465 with appropriate valving may be connected to threaded opening 466 on the outer end of surface drain nipple 458.

Once drain collar 454 and surface drain nipple 458 are thus positioned, metering nipple 296 and air chamber 308 are removed from sampler module 214 by breaking threaded connection 298. An opening tool or nipple 468, with an externally threaded portion 470 is threadingly engaged with metering case 266 to form a new threaded connection 471 after removal of drain nipple 296.

Opening nipple 468 has pin means such as an elongated pin portion 472 thereon which extends into metering case 266 past shoulder 452, thus coming in contact with lower end 474 of metering valve 278. As opening nipple 468 is threaded into metering case 266 for a complete threaded connection 298, it will be seen that pin portion 472 displaces metering valve 278 upwardly until annulus 282 is once again in fluid communication with hole 274 and thus in fluid communication with passageway 476 of surface drain nipple 458. Fluid is thus free to flow out of sampler module chamber 450 until piston 260 again reaches its lowermost position in contact with upper face 478 of metering case 266. Thus, a safe and reliable means of draining each sampler module 214 is provided.

It will be seen, therefore, that the perforate, test and sample tool and the sampler of the present invention are well adapted to carry out the ends and advantages mentioned as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. A downhole tool adapted for connection to a tool string for use in a well bore, said tool comprising:
   - packer means for sealingly engaging with said well bore;
   - perforation means for perforation of said well bore for allowing formation fluids to flow into a well annulus defined between said tool and said well bore below said packer means;
   - sampling means for entrapping a sample of said formation fluid without flowing well fluids into said tool string for subsequent removal of said sample from said well bore; and
   - valve means for opening and closing said sampling means.

2. The tool of claim 1 wherein said valve means is opened and closed in response to a pressure differential between an internal pressure in said tool and a pressure in a portion of a well annulus above said packer means.

3. The tool of claim 1 further comprising clean-up means for collecting debris resulting from said perforation and mud filtration prior to opening of said valve means.

4. The tool of claim 3 wherein:
   - said perforation means is characterized by a perforating gun defining fluid flow passages therethrough after firing thereof; and
   - said clean-up means is characterized by an empty casing portion disposed below said gun and in fluid communication with said fluid flow passages such that fluid and debris flow into said casing portion after firing of said guns.

5. The tool of claim 1 further comprising shear means for holding said valve means in a closed position prior to opening of the valve means.

6. The tool of claim 1 further comprising locking means for locking said valve means in a closed position after closure of the valve means.

7. The tool of claim 1 wherein said sampling means comprises longitudinally spaced sampling modules adapted for entrapping separate samples of said fluid.

8. The tool of claim 7 further comprising gauge means adjacent said sampling modules for measuring at least one of a fluid pressure and a fluid temperature adjacent said sampling modules.

9. A downhole tool for testing fluid from a formation reservoir in a well, said tool comprising:

a packer connectable to a tool string and sealingly engageable with a well bore such that a first well annulus is defined above the packet and a second well annulus is defined therebelow;

a cylinder adjacent said packer and defining a central opening therethrough;

an operating piston slidably disposed in said central opening of said cylinder;

a fluid sampler disposed below said packer and defining a sampling chamber and a sample port therein in communication with said second well annulus, said sampling chamber having no communication with said tool string; and a valve connected to said piston for movement therewith and slidably disposed in said sampler for opening and closing said sampler port.

10. The tool of claim 9 wherein:

said cylinder comprises port means for providing communication between said first well annulus and said central opening of said cylinder;

said operating piston is disposed in said cylinder such that an annular volume is defined therebetween in communication with said port means; and further comprising sealing means on said operating piston for sealingly separating said annular volume from an upper portion of said piston, such that said piston is movable in response to pressure in said first well annulus and pressure in said tool above said piston.

11. The tool of claim 9 further comprising a perforating gun positionable adjacent said formation for perforation thereof such that formation fluid is free to flow into said second well annulus.

12. The tool of claim 11 further comprising an empty casing portion disposed below said perforating gun and in communication therewith, whereby at least a portion of debris resulting from said perforation will flow through said perforating gun and into said casing portion.

13. The tool of claim 9 further comprising shear means for holding said piston and thereby maintaining said valve in a closed position as said tool is run into said well bore.

14. The tool of claim 9 further comprising locking means for locking said piston and thereby maintaining said valve in a closed position as said tool is pulled out of said well bore.

15. The tool of claim 14 wherein said locking means is characterized by a locking dog assembly lockingly engageable with a groove o said operating piston.

16. The tool of claim 9 further comprising an individual sampler module positioned in said sampling chamber in said sampler, said sampler module comprising:

valve means openable in response to fluid pressure in said sampling chamber; and means for automatically closing said valve means when a predetermined fluid volume is in said module.

17. A method of sampling fluid from a wall formation comprising the steps of:

positioning a tool in a wall bore on a tool string, said tool comprising:

a perforating gun;

a self-contained sampler adjacent said perforating gun and having a sampler valve therein; and a packer adjacent said sampler; setting said packer such that a well annulus is defined thereabove and therebelow;

actuating said gun for perforating said formation;

opening said sampler valve while keeping said sampler isolated from said tool string;

filling said sampler with a predetermined volume of formation fluid from said well annulus below said packer and keeping said volume isolated from said tool string;

closing said sampler valve;

unsetting said packer;

removing said tool from said well bore; and draining fluid from said sampler.

18. The method of claim 17 wherein:

said sampler valve is a pressure responsive sampler valve;

said step of opening said sampler valve comprises lowering pressure in said well annulus above said packer for creating a pressure differential across said sampler valve; and said step of closing said valve comprises raising pressure in said well annulus above said packer and lowering pressure in said tool for providing a reverse pressure differential across said sampler valve.

19. The method of claim 17 wherein said sampler comprises at least one individual sampler module disposed therein and further comprising the step of filling said sampler module with a separate volume of formation fluid.

20. The method of claim 17 further comprising, prior to opening said sampler valve, the step of entrapping debris resulting from said perforation and mud filtration in a casing portion below said gun.

* * * * *